United States Patent [19]

Hewitt et al.

[11] Patent Number: 4,555,026

[45] Date of Patent: Nov. 26, 1985

[54] ENVELOPE

[75] Inventors: Edward G. Hewitt, Auburn; William D. Pasquale, Northboro, both of Mass.

[73] Assignee: New England Mfg. Co., Worcester, Mass.

[21] Appl. No.: 727,818

[22] Filed: Apr. 26, 1985

Related U.S. Application Data

[63] Continuation-in-part of Ser. No. 613,457, May 24, 1984.

[51] Int. Cl.[4] ..... B65D 27/00; B65D 85/30

[52] U.S. Cl. ..... 206/521

[58] Field of Search ..... 229/68 R; 206/521; 229/72, 75, 80

[56] References Cited

U.S. PATENT DOCUMENTS

| | | | |
|---|---|---|---|
| 331,355 | 12/1885 | Williams | 229/72 |
| 698,300 | 4/1902 | Mann | 229/75 |
| 1,108,540 | 8/1914 | Ahlquist | 229/80 |
| 2,099,303 | 11/1937 | Hohwart | 229/80 |
| 2,423,027 | 6/1947 | Hopkins | 229/72 |
| 2,514,295 | 7/1950 | Scurich, Jr. | 206/521 |
| 2,952,398 | 9/1960 | Gerard | 206/521 |
| 3,592,380 | 7/1971 | Gerard | 206/521 |
| 4,190,161 | 2/1980 | Gendron | 229/80 |

*Primary Examiner*—Stephen P. Garbe

*Attorney, Agent, or Firm*—Blodgett & Blodgett

[57] ABSTRACT

Envelope formed with a front panel and a rear panel joined by end flaps, wherein the contents are protected by cells formed by gum attachment of the end edges only of the rear panel to the front panel and of the end edges only of the flaps to the rear panel.

4 Claims, 3 Drawing Figures

ENVELOPE

CROSS-REFERENCE TO RELATED APPLICATIONS

This application is a continuation-in-part of application Ser. No. 613,457 filed May 24, 1984.

BACKGROUND OF THE INVENTION

In the use of envelopes for mailing, there has always been a problem of damage to the contents. This problem has increased recently, due to the tendency to mail bulky materials in envelopes. Any tearing or crushing of the end edges of the envelope tends to result in damage to the contents. The problem is experienced, for instance, by those companies that mail advertising brochures with their bills; the entire assemblage makes a bulky package that tends to pull at the end seams of the envelope. Any tearing at that edge also damages the bill, leading to a situation that is disagreeable to the customer who receives the material. If a mailing envelope is enclosed with the bill, any injury to the contents is doubly undesirable. These and other difficulties experienced with the prior art devices have been obviated in a novel manner by the present invention.

It is, therefore, an outstanding object of the invention to provide an envelope having a protective structure at the ends to prevent damage to the contents.

Another object of this invention is the provision of envelope constructed to form a protective cell at the ends.

A further object of the present invention is the provision of an envelope having an end construction which spaces the contents inwardly of the ends and centers the contents.

It is another object of the instant invention to provide an envelope having end protection means, which envelope can be assembled on a standard envelope-making machine.

A still further object of the invention is the provision of an envelope which is simple in construction, which is inexpensive to manufacture, and which is capable of a long life of useful service.

With these and other objects in view, as will be apparent to those skilled in the art, the invention resides in the combination of parts set forth in the specification and covered by the claims appended hereto.

SUMMARY OF THE INVENTION

In general, the invention consists of an envelope having a rectangular front panel and a rectangular rear panel that is attached to the front panel along a bottom edge fold line. An end flap is hingedly attached along a fold line to each of two opposed end edges of the front panel, while a top flap is connected by a fold line to a top edge of the front panel. A narrow gum strip is located on the inner surface of the rear panel adjacent each of two opposed end edges to permit attachment to the inner surface of the front panel adjacent the said end edges. A narrow gum strip is located on the inner surface of each end flap adjacent an end edge to permit attachment of each end flap to the outer surface of the rear panel at a position spaced inwardly a substantial distance from the said end edges of the rear panel.

More specifically, a bulky package inserted centrally between the front and rear panels causes the rear panel and the end flap to form a cylindrical cell between the adjacent gum strips, the cell having a generally oval-shaped cross-section.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
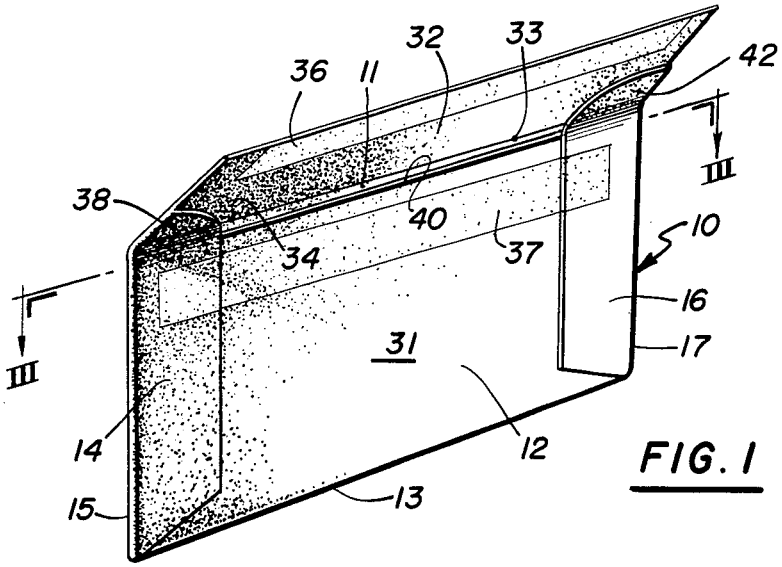
FIG. 1 is a perspective view of an envelope embodying the principles of the present invention.

Referring first to FIG. 1, which best shows the general features of the invention, the envelope, indicated generally by the reference numeral 10, is shown as consisting of a front panel 11, a rear panel 12, two end flaps 14 and 16, a top flap 32, and two gussets 38 and 42.

Figure 2:
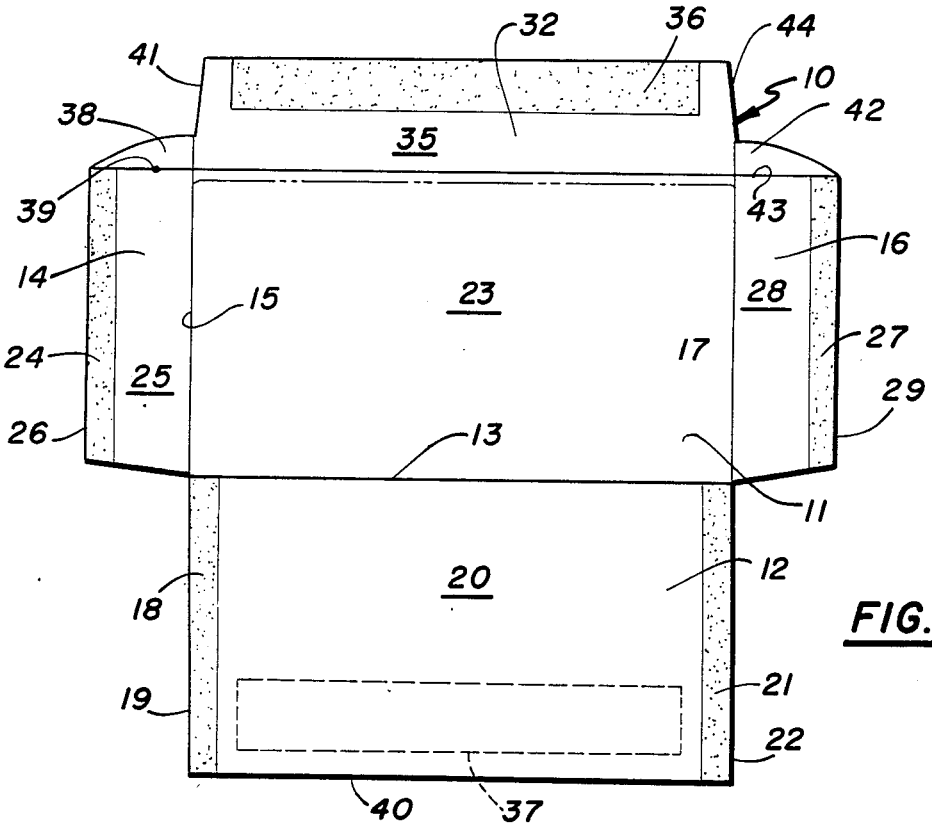
FIG. 2 is plan view of a blank from which the envelope can be made.

The details of the invention are shown in FIGS. 1 and 2. The front panel 11 is rectangular and is hingedly attached to the rear panel 12 along a bottom edge fold line 13. The end flap 14 is attached to the front panel 11, at an end edge 15, while the end flap 16 is attached to the front panel at the other end edge 17.

A narrow gum strip 18 is located on the inner surface 20 of the rear panel 12 adjacent an end edge 19 and a similar gum strip 21 is located on the inner surface of the rear panel next to the other end edge 22. These gum strips permit the attachment of the rear panel to the inner surface 23 of the front panel adjacent the end edges 15 and 16.

A narrow gum strip 24 is located on the inner surface 25 of the end flap 14 adjacent the end edge 26, while a similar gum strip 27 is formed on the inner surface 28 of the end flap 16 adjacent the end edge 29. The gum strips 24 and 27 permit the attachment of the flaps 14 and 16 to the outer surface 31 of the rear panel 12 at positions spaced inwardly a substantial distance from the side edges 19 and 22, respectively.

The top flap 32 is connected along a fold line 33 to a top edge 34 of the front panel 11, the inner surface 35 of the top flap being provided with a gum strip 36 for attachment to the outer surface 31 of the rear panel. A similar gum strip 37 is provided on the outer surface 31 of the rear panel 12 adjacent a top edge 40 thereof for interaction with the gum strip 36 of the top flap.

The gussets 38 and 42 are each generally in the shape of a right triangle, but with the hypotenuse curved outwardly. The gusset 38 joins the top edge 39 of the end flap 14 to the adjacent end edge 41 of the top flap; it is connected to both flaps by fold lines. Similarly, the gusset 42 joins the top edge 43 of the end flap 16 to the end edge 44 of the top flap; fold lines join the gusset to the top flap and the end flap.

The operation and advantages of the invention will now be readily understood in view of the above description. To assemble the envelope shown in FIG. 1 from the blank shown in FIG. 2, the rear panel 12 is rotated about the bottom edge fold line 13. The inner surface 20 of the rear panel contacts the inner surface 23 of the front panel and the gum strips 18 and 21 fasten the edge area of the rear panel to the front panel. Then, the flap 14 and the gusset 38 are rotated about the end edge 15 of the front panel and into contact with the outer surface 31 of the rear panel. The gum strip 24 fastens the area adjacent the edge 26 to the rear panel at a position substantially spaced from the edge 19. In a similar way, the flap 16 is rotated about the end edge 17 of the front panel, so that the inner surface 28 of the flap contacts the outer surface of the rear panel and is fastened to it by the gum strip 27 at a position substantially spaced inwardly of the end edge 22. In this condition, the gussets 38 and 42 are in contact with the inner surface 32 of the top flap. This is the form of the envelope in which it is delivered to the user.

Figure 3:
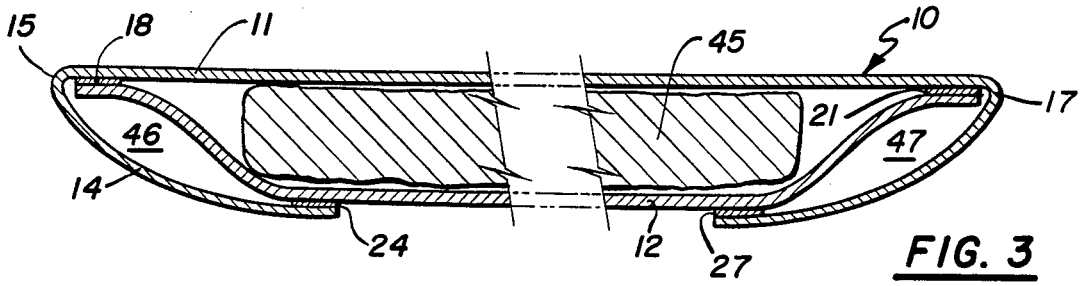
FIG. 3 is a sectional view of the envelope taken on the line III—III of FIG. 1.

In use, the contents 45 (FIG. 3) are inserted into the envelope between the front panel 11 and the rear panel 12; normally, the contents, consisting of a stack of papers such as a bill and advertising brochures, will extend laterally beyond the gum strips 24 and 27, but not as far as the gum strips 18 and 21. The thickness dimension of the contents 45 serves to force the front and rear panels into a spaced parallel condition, as shown in FIG. 3. At that time, the portions of the rear panel 12 and the flaps 14 and 16 subtended between the gum strips 18 and 24 (in the case of the flap 14) and the gum strips 21 and 27 (in the case of the flap 16) are bowed to form cells 46 and 47 at the ends of the envelope. Each of these cells is in the form of a cylindrical tube extending parallel to the end edges 15 and 17. The cross-sectional shape of each cell is generally that of an oval having cusps or points at the ends. The part of the cells 46,47 formed by the flap 14, 16, respectively, is generally a segment of a circle, while the portion formed by the rear panel 12 is an ogee or reverse curve. It can be seen, then, that the ends of the package of contents 45 contact the surfaces of the cells, i.e., the inner surface 20 of the rear panel, so that the cells not only serve to center the contents, but also serve as a shock-absorbing element. Furthermore, the cells protect the contents from tearing or bruising of the ends of the envelope during handling.

The advantages of the invention are obtained without structural complications in the envelope and can be made without added manufacturing cost, since the envelope can be formed on a standard envelope-making machine.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

We claim:

1. Envelope, comprising:

(a) a rectangular front panel, (b) a rectangular rear panel attached to the front panel along a bottom edge fold line, (c) an end flap attached to each of two opposed end edges of the front panel, (d) a narrow gum strip located on the inner surface of the rear panel adjacent each of two opposed end edges to permit attachment to the inner surface of the front panel adjacent its said end edges, and (e) a narrow gum strip located on the inner surface of each end flap adjacent an end edge to permit attachment of each end flap to the outer surface of the rear panel at a position spaced inwardly a substantial distance from the said end edges of the rear panel, wherein a bulky package inserted centrally between the front and rear panels separates a central portion of the rear panel from the front panel, while the narrow gum strip located on the inner surface of the rear panel adjacent the end edge maintains the adjacent portion of the rear panel against the front panel, so that the rear panel buckles into an ogee shape due to the stiffness of the material from which the panel is formed, thus forming a cylindrical cell at each end extending parallel to the end edge and lying between the two adjacent gum strips.

2. Envelope as recited in claim 1, wherein a top flap is connected by a fold line to a top edge of the front panel, the flap being provided on its inner surface with a gum strip for attachment to the outer surface of the rear panel.

3. Envelope as recited in claim 2, wherein a gum strip is provided on the outer surface of the rear panel adjacent a top edge thereof for interaction with the aforementioned gum strip on the top flap.

4. Envelope as recited in claim 1, wherein a gusset joins the top edge of each end flap to the adjacent end edge of the top flap and is connected to both flaps by fold lines, so that the gusset lies against the inner surface of the top flap when the side flap lies against the outer surface of the rear panel and so that the gusset lies against the outer surface of its end flap when the top flap lies against the outer surface of the rear panel.

* * * *